United States Patent [19]

Betts

[11] 4,208,967

[45] Jun. 24, 1980

[54] SQUIB DESIGN

[75] Inventor: Robert E. Betts, Huntsville, Ala.

[73] Assignee: The United States of America as represented by the Secretary of the Army, Washington, D.C.

[21] Appl. No.: 905,833

[22] Filed: May 15, 1978

[51] Int. Cl.[2] ..... F42B 3/12

[52] U.S. Cl. ..... 102/28 EB; 102/203

[58] Field of Search ..... 102/28 R, 28 M, 28 EB, 102/46, 202, 203

[56] References Cited

U.S. PATENT DOCUMENTS

| | | | |
|---|---|---|---|
| 2,604,044 | 7/1952 | Sevold | 102/28 M |
| 2,761,386 | 9/1956 | Zebree | 102/28 R |
| 2,934,014 | 4/1960 | Smith et al. | 102/28 R |
| 3,003,419 | 10/1961 | Fife, Jr. | 102/202 |
| 3,135,200 | 6/1964 | Jackson | 102/28 R |
| 3,227,083 | 1/1966 | Moses et al. | 102/28 R |
| 3,420,174 | 1/1969 | Potter | 102/28 R |
| 3,910,188 | 10/1975 | Stevens | 102/28 M |

FOREIGN PATENT DOCUMENTS

| | | | |
|---|---|---|---|
| 857281 | 12/1960 | United Kingdom | 102/28 EB |

OTHER PUBLICATIONS

"General Discussion of Pyrofuze Wire for Application of Bridging", Sigmund Cohn Corp., Mt. Vernon, N.Y.
"Pyrofuze Application to Bridge Type Initiation", Pyrofuze Corp., Mt. Vernon, N.Y., 1965.

*Primary Examiner*—David H. Brown
*Attorney, Agent, or Firm*—Nathan Edelberg; Robert P. Gibson; Jack W. Voigt

[57] ABSTRACT

The electrically initiated squib of this invention is comprised of a plug member with a pair of spaced apart electrical leads extending through the plug member into a holder member for containing a predetermined quantity of an easily-ignitable composition. A bridgewire that is constructed of a bimetallic composite (Pyrofuze) selected from palladium and aluminum, platinum and aluminum, and ruthenium-palladium alloy and aluminum is secured between the electrical lead ends that terminate in the holder member of the squib. The holder member is loaded with a loose, easily-ignitable composition which is a finely-ground and intimate mixture of a pyrotechnic which is a composition selected from the group consisting of 45% by weight zirconium and 55% by weight potassium perchlorate, 20% by weight boron and 80% by weight potassium nitrate, 45% by weight aluminum flake (17 to 44 microns) and 55% by weight potassium perchlorate (6 to 17 microns), and lead azide or lead styphnate, or a single-base, a double-base, or composite propellant composition in a powder or pellet form. The combination improves the reliability of the squib while reducing the controls on loading and assembly procedures. The amount of easily-ignitable composition to ensure ignition need not be controlled, since the proximity of the easily-ignitable composition to the bimetallic composite bridgewire is not critical. The amount of material that the bridgewire ignites may govern the squib output; however, the reliability of ignition is ensured by the presence of the easily-ignitable composition in the holder member where the bimetallic composite undergoes a violent exothermic reaction after being brought to its ignition temperature by the application of electric current. The violent exothermic reaction is accompanied by a deflagration or a throwing out of the high temperature constituents of the bimetallic bridgewire.

3 Claims, 2 Drawing Figures

SQUIB DESIGN

DEDICATORY CLAUSE

The invention described herein may be manufactured, used, and licensed by or for the Government for governmental purposes without the payment to me of any royalties thereon.

BACKGROUND OF THE INVENTION

The conventional bridgewire employed in a squib or igniter is required to be in intimate contact with the pyrotechnic material for reliable ignition. To ensure the presence of pyrotechnic in the proximity of the bridgewire, at least in the manufacturing process, the pyrotechnic is spotted or beaded on the bridgewire with any additional amount of pyrotechnic being uniformly loaded in proximity to the beaded bridgewire. With adverse environment applied to the squib, the bridgewire-pyro-interface may change. Such changes may include cracks, air bubbles or voids adjacent to the bridgewire thus causing the bridge to "burn" in the area of no pyrotechnic. This will cause increase delay times and possibly failures to the point of no ignition. Even without severe adverse environmental exposure functional delay times at some given electrical current level can be a problem, even for uniformly loaded squibs. For example, squibs which are consistently uniformly loaded may exhibit a delay time of several milliseconds with 5.0 amps of current.

Special requirements have placed additional demands on the squib or initiator designer. For example, one such requirement has been a 1 watt/1 amp no-fire characteristic initiator of the type required for initiating action of a destruct unit for rocket motor cases for weather rockets. This initiator could be mass produced to a thinness of about 0.070 inch which made it ideally suited for fitting into the approximate 0.100 inch space envelope of the honeycomb of a rocket motor case. A one watt-/one amp no-fire match type initiator is described and claimed in U.S. Pat. No. 3,910,188 issued to Philip M. Stevens on Oct. 7, 1975 and assigned to the United States of America as represented by the Secretary of the Army, Washington, D.C. This match type initiator is comprised of a Pyrofuze bridgewire soldered between a bared length of the conductors of a dual conductor flat cable and covered with an ignition material with about 90% by weight of the material being comprised of lead thiocyanate, potassium chlorate, and charcoal and with about 10% by weight of the material being a binder. An external epoxy adhesive coating seals the initiator thereby obviating the requirement of an initiator case.

There exists a need for a highly reliable squib which can employ proven components and proven means for assembling. Additionally, there is a need for a highly reliable squib which employs proven components and proven means for assembling while reducing the controls on loading and assembling procedures.

Therefore, an object of this invention is to provide a squib or initiator that has improved reliability, while reducing the controls on loading the pyrotechnic and assembling procedures.

Another object of this invention is to provide a squib that employs a bimetallic bridgewire in combination with loose pyrotechnics, propellants and mixtures of exothermic materials.

A further object of this invention is to provide a squib that employs a bimetallic bridgewire that exhibits the characteristic of throwing out constituents from an alloying reaction which proceeds violently and exothermically following the application of electric current. The throwing out of constituents being within a confined volume of relatively small proportions and occuring in the vicinity of a loading of an easily-ignitable pyrotechnic or a powdered double-base propellant, single-base propellant, or a powdered composite propellant permits less control of the loading and assembling procedures while retaining improved reliability.

SUMMARY OF THE INVENTION

The electrically ignited squib of this invention employs a bimetallic bridgewire that alloys violently and exothermically within a holder of a confined volume of relatively small proportions. The squib is comprised of a plug member with a pair of spaced apart electrically insulated lead members extending through the plug member into a holder member for containing a predetermined quantity of an easily-ignitable composition. The bridgewire which is constructed of a bimetallic composite selected from palladium and aluminum, platinum and aluminum, and ruthenium-palladium alloy and aluminum is secured between the lead ends of the lead members that terminate in the holder member of the squib. The holder member is loaded with a predetermined quantity of a loose, easily-ignitable composition which is a finely-ground and intimate mixture of a pyrotechnic composition selected from the group consisting of 45% by weight zirconium and 55% by weight potassium perchlorate, 20% by weight boron and 80% by weight potassium nitrate, 45% by weight aluminum and 55% by weight potassium perchlorate, lead azide or lead styphnate, and a single-base, double-base or composite propellant composition in a powder or pellet form.

DESCRIPTION OF THE PREFERRED EMBODIMENT

Figure 1:
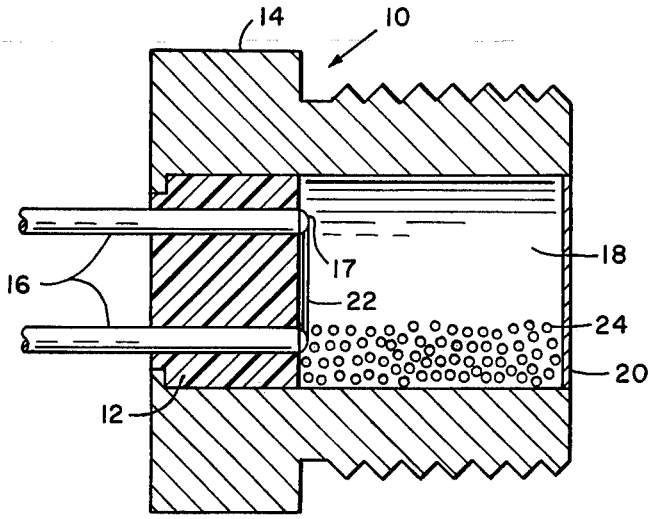
FIGS. 1 and 2 of the drawing are sectional views of electrically initiated squibs of this invention.

In further reference to the drawing, numerals are assigned to identify the designated parts of the electrically initiated squib of this invention. The electrically initiated squib 10 of FIG. 1 of this invention is comprised of an insulating plug member 12 positioned in a housing member 14. A pair of electrically insulated lead members 16 extend through the plug member 12, and the ends 17 of the electrically insulated lead members terminate in a holder member 18 which is defined by the housing member 14 and end cap 20. A bimetallic bridgewire 22 is secured between the terminated ends of the electrically insulated lead members. The holder member 18 contains a predetermined quantity of an easily-ignitable composition 24 in a confined volume of relatively small proportion. In use, after electrical current is supplied to the bimetallic bridgewire, an alloying reaction takes place violently and exothermically which produces temperatures in excess of the boiling point of the bridgewire constituents. Minimum temperatures of about 2800° C. results from the alloying reaction. The bridgewire is constructed of a bimetallic composite selected from palladium and aluminum, platinum and aluminum, and a ruthenium-palladium alloy and aluminum. A predetermined quantity of a loose, easily-ignitable composition is loaded in the holder member. The predetermined quantity of the composition is based on a portion of a confined volume of relatively small proportions. The design of the squib is such that the cavity in which the bridgewire and pyrotechnic is placed retains the throw pattern of the bridgewire. When the easily-ignitable composition is within the throw pattern of the bridgewire, ignition is assured. In a conventional squib, failure can result if the beaded bridgewire crack or the bridgewire-pyrotechnic-interface changes after manufacture. A "burn" could take place in the area of no pyrotechnic. This will cause increased delay times and possibly failures to the point of no ignition.

Figure 2:
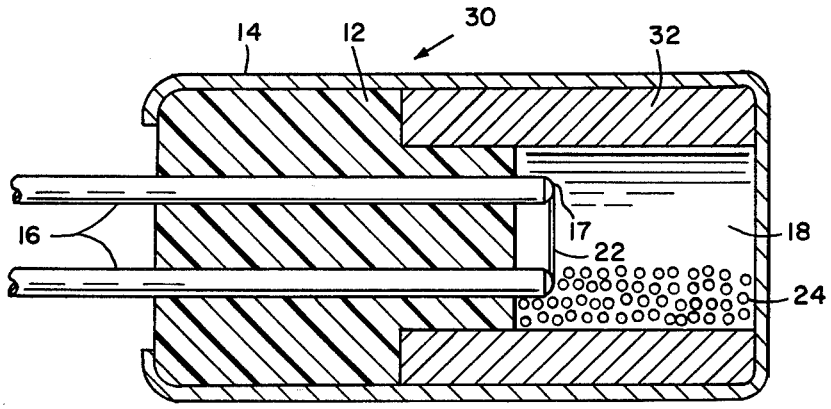

An alternate design for an electrically initiated squib of this invention is shown in FIG. 2 as an electrically initiated squib 30 wherein like numbers for equivalent parts are shown as identified in FIG. 1. The squib of FIG. 2 is designed with a case which does not require an end cap as shown in FIG. 1. This design employs a spacer member 32 which in combination with the housing member defines the holder member wherein a predetermined quantity of a loose pyrotechnic 24 is loaded. This design employs a unitary housing member 14 into which the insulating plug member 12 containing the lead wires 16 is positioned after the predetermined quantity of an easily-ignitable composition 24 has previously been loaded. The plug member can be formed of mineral filled phenolic or glass. The case material is designed of a material which is formed to fit the contour of the plug member to provide the sealing and retaining function for the plug member. In use, the thin case would be ruptured to release the high temperature material which ignites the propellant or explosive charge. In a similar fashion, the design of FIG. 1 provides for displacement of the end cap to release the high temperature material which ignites the propellant or explosive charge.

Thus, uniformity of loading is the variable of the conventional squib manufacturing process which has been reduced to the point for the squib of this invention where the amount of pyrotechnic to ensure ignition need not be precisely controlled. Broadly defined, the presence of any of the easily-ignitable composition which is present in the area of the throw pattern of the bridgewire is a sufficient amount to ensure ignition. As an example, a bridgewire of the dimensions 0.001"×0.060" long would be placed in a cavity or holder member which is a cylinder of about 0.125" diameter by 0.200" high. The pyrotechnic is placed in the cavity of the holder member as it is with any other type of squib; however, the amount of pyrotechnic or the easily-ignitable composition need not be controlled. In this example, it has been determined that the easily-ignitable composition present in the cavity is well within the throw pattern of the bridgewire.

A suitable bridgewire for use in the squib of this invention is the bimetallic composite bridgewire sold commercially under the name Pyrofuze, from Sigmund Cohn Corporation. The use of Pyrofuze as a bridge material is well known to operate in squibs of the conventional design. The properties of Pyrofuze which causes it to throw out particles has been utilized in the squib design of this invention to improve the reliability of the electrically initiated squib while reducing the controls of loading and assembling procedures. The chances of squib failure due to no ignition should be drastically reduced.

For convenience of the user, pyros which can be used in the new squib design of this invention are group by the following pyrotechnic groups A–C listed below.

Pyrotechnic group A—Metal Fuel-Oxidizers

1. Mag-Teflon (polytetrafluoroethylene)
   60% magnesium
   40% Teflon
2. Boron-Potassium Nitrate
   Boron: 23.7±2%
   Potassium Nitrate: 70.7±2%
   Binder: 5.6
3. Zirconium-Potassium Perchlorate

| | | |
|---|---|---|
| Zr | 45% | 10 Microns |
| $KClO_4$ | 55% $KClO_4$ | 6 to 17 Microns |

4. Aluminum flake (17–44 microns) 45%-potassium perchlorate (6 to 17 microns) 55%.

Pyrotechnic group B—Primary Explosives

1. Lead Azide
2. Lead Styphnate
3. Etc.

Pyrotechnic group C—Propellants

1. Double-Base (any kind)
2. Single-Base (any kind)
3. Composite (any kind)
4. Black Powders
5. Etc.

I claim:

1. An electrically initiated squib allowing reduced loading and assembling procedures while attaining improved reliability for igniting, said electrically initiated squib comprising in combination:

(i) a pair of electrically insulated lead members positioned in a spaced apart relationship and extending through an insulating plug member, said lead members having terminated ends outside said insulating plug member;

(ii) a bridgewire fastened between said terminated ends of said lead members, said bridgewire constructed of a bimetallic composite selected from the group consisting of palladium and aluminum, platinum and aluminum, and ruthenium-palladium alloy and aluminum, said bridgewire having the capability of igniting an appropriate charge loosely confined within a holder member, said charge being spaced from said bridgewire and within a throw pattern of said bridgewire; and, (iii) a housing member for containing said insulating plug member, said lead members, and said bridgewire, said housing member and said plug member when in combination additionally defining a holder member that contains a predetermined quantity of said appropriate charge as a loose, easily-ignitable composition within the throw pattern of said bridgewire after said bridgewire is brought to its ignition temperature by the application of electrical current, said ignition temperature causing a violent exothermic reaction that is accompanied by a deflagration or a throwing out of the high temperature constituents of said bimetallic bridgewire, said easily-ignitable composition being a composition selected from the group of easily-ignitable compositions specified under pyrotechnic groups A-C as follows:

Pyrotechnic group A: metal fuel-oxidizer, composition 1: magnesium 60% by weight and polytetrafluoroethylene 40% by weight; composition 2: boron 23.7%±2% by weight, potassium nitrate 70.7%±2% by weight, and binder 5.6% by weight; composition 3: zirconium 10 microns particle size 45% by weight and potassium perchlorate 6 to 17 microns particle size 55% by weight; and composition 4: aluminum flake 17 to 44 microns particle size 45% by weight and potassium perchlorate 6 to 17 microns particle size 55% by weight;

Pyrotechnic group B: primary explosive, composition 1: lead azide; and composition 2: lead styphnate;

Pyrotechnic group C: propellants, composition 1: double-base propellants; composition 2: single-base propellants; composition 3: composite propellants; and composition 4: black powders.

2. The electrically initiated squib as defined in claim 1 wherein said housing member is provided with an end cap which in combination with said housing member defines said holder member.

3. The electrically initiated squib as defined in claim 1 wherein a spacer member is employed in combination with said housing member to define said holder member, said housing member being in the form of a unitary construction.

* * * * *